US007682162B2

(12) United States Patent
Yuan

(10) Patent No.: US 7,682,162 B2
(45) **Date of Patent: *Mar. 23, 2010**

(54) LOW PROFILE CONNECTOR FOR CONNECTING WITH CABLE

(75) Inventor: Wei Yuan, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/538,787

(22) Filed: Aug. 10, 2009

(65) Prior Publication Data

US 2010/0035477 A1 Feb. 11, 2010

(30) Foreign Application Priority Data

Aug. 10, 2008 (CN) ..... 2008 2 0041234

(51) Int. Cl.
*H01R 12/00* (2006.01)

(52) U.S. Cl. ..... 439/76.1; 439/902

(58) Field of Classification Search ..... 439/76.1, 439/694, 855, 881, 902
See application file for complete search history.

(56) References Cited

U.S. PATENT DOCUMENTS

| | | | | |
|---|---|---|---|---|
| 7,318,741 | B2 | 1/2008 | Wu | |
| 7,563,108 | B1 * | 7/2009 | Wu | 439/76.1 |
| 2005/0181642 | A1 * | 8/2005 | Juntwait | 439/76.1 |
| 2008/0102655 | A1 * | 5/2008 | Lin | 439/76.1 |

* cited by examiner

*Primary Examiner*—Tho D Ta
(74) *Attorney, Agent, or Firm*—Wei Te Chung; Andrew C. Cheng; Ming Chieh Chang

(57) ABSTRACT

A cable assembly comprises an insulative housing having a body portion and a mating portion extending forward from a front side of the body portion along a mating direction. The body portion forms a supporting portion protruding rearward and extending along a transversal direction thereof. A plurality of contacts are disposed in the insulative housing with front contacting sections exposed in the mating section and rear tails opposite to the front contacting sections. A printed circuit board stands within the supporting portion and electrically and mechanically connects with the tails of the contact. A cable connects with a free end of the printed circuit board and a cover is assembled onto the insulative housing to enclose said printed circuit board and the cable therein. The configuration of the cable assembly is compact and meets the low profile demand.

10 Claims, 6 Drawing Sheets

LOW PROFILE CONNECTOR FOR CONNECTING WITH CABLE

BACKGROUND OF THE INVENTION

1. Field of the Invention

The present invention relates to a cable assembly, and more particularly to a lower profile cable assembly.

2. Description of the Related Art

U.S. Pat. No. 7,318,741 issued to Wu on Jan. 15, 2008 discloses a cable assembly. The cable assembly includes an insulative housing, a number of contacts disposed in the housing, an insulator with a base and a distal portion extending upwardly from the base, a plurality of conductive wires, and a cover. The wire comprises a plurality of conductors received in the distal portion of the insulator, passing through the base and connected to a rear portion of the housing. The cover is assembled on the rear portion of the housing to enclose the insulator, and has a body portion and a receiving portion behind the body portion. The base of the insulator is received in the body portion of the cover, and the distal portion of the insulator is received in the receiving portion of the cover. The cables extend out of the cover from a lateral side thereof.

However, a thickness dimension of the cable assembly may be a little large as accessories aforementioned of the cable assembly being arranged in the same direction.

Obviously, an improved cable assembly is highly desired to overcome the aforementioned problem.

SUMMARY OF THE INVENTION

Accordingly, an object of the present invention is to provide a low profile cable assembly.

In order to achieve the object set forth, a cable assembly in accordance with the present invention comprises an insulative housing having a body portion and a mating portion extending forward from a front side of the body portion along a mating direction. The body portion forms a supporting portion protruding rearward and extending along a transversal direction thereof. A plurality of contacts are disposed in the insulative housing with front contacting sections exposed in the mating section and rear tails opposite to the front contacting sections. A printed circuit board stands within the supporting portion and electrically and mechanically connects with the tails of the contact. A cable connects with a free end of the printed circuit board and a cover is assembled onto the insulative housing to enclose said printed circuit board and the cable therein.

Other objects, advantages and novel features of the invention will become more apparent from the following detailed description of the present embodiment when taken in conjunction with the accompanying drawings.

DETAILED DESCRIPTION OF THE INVENTION

Figure 1:
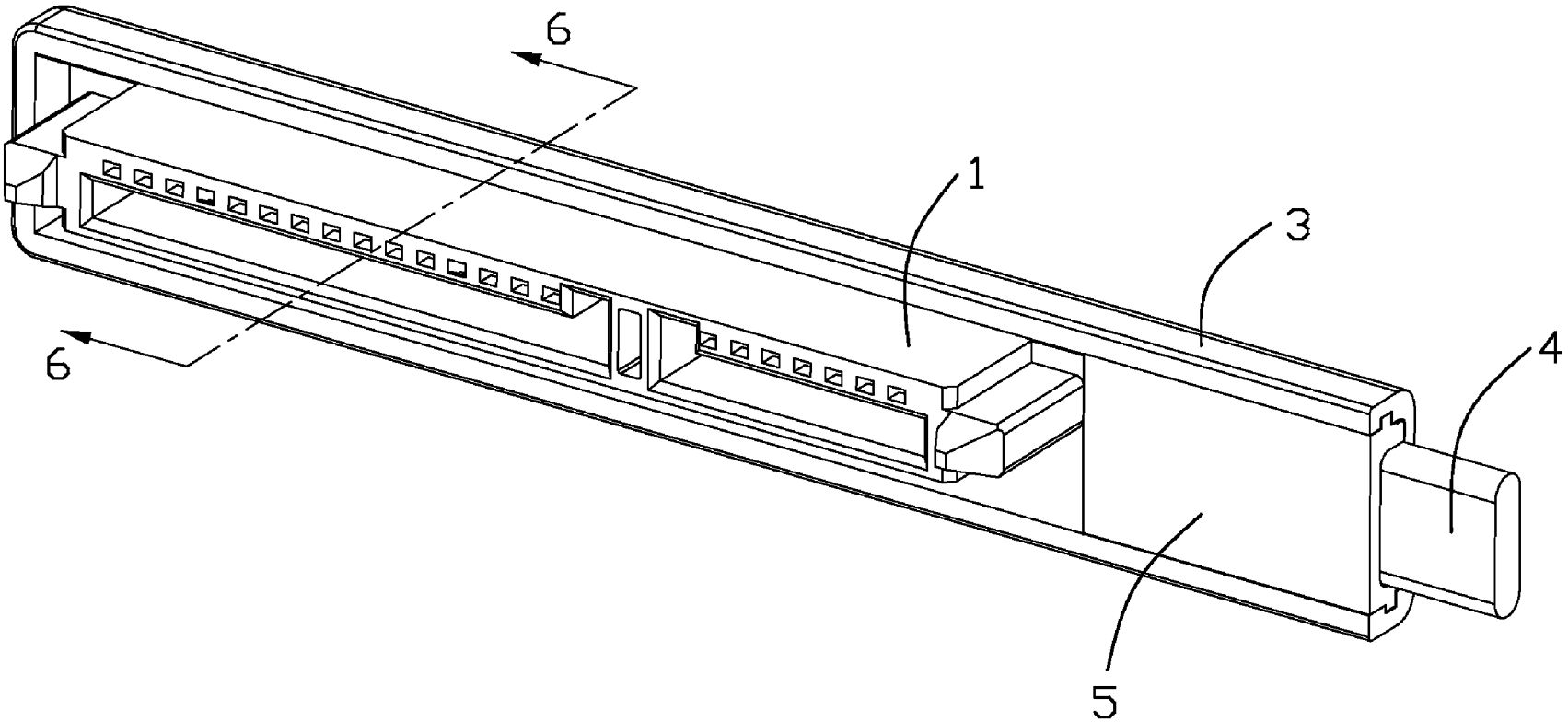
FIG. 1 is an assembled perspective view of a cable assembly in accordance with the present invention.
Figure 2:
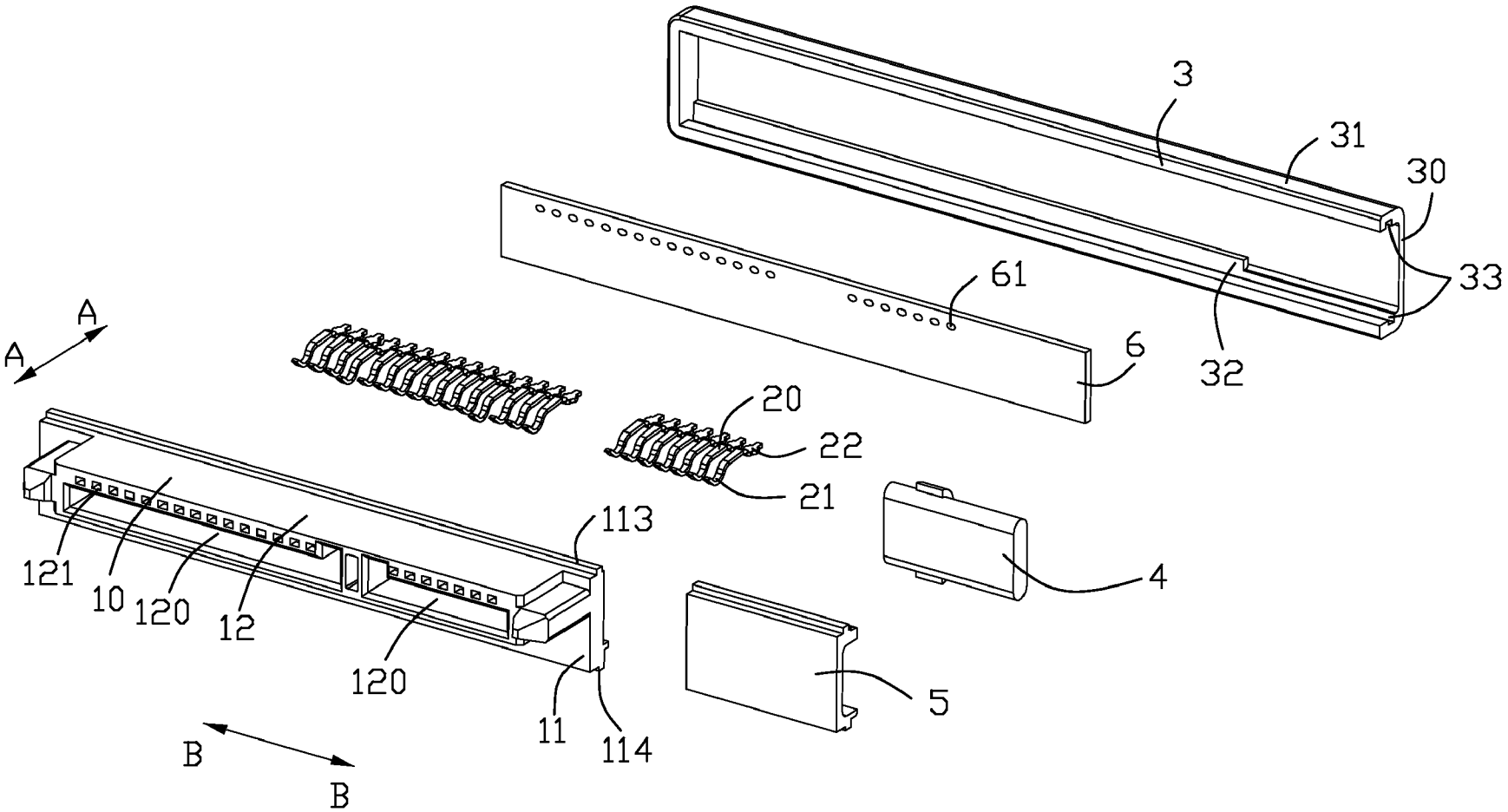
FIG. 2 is an exploded perspective view of the cable assembly shown in FIG. 1.

Reference will now be made to the drawing figures to describe a preferred embodiment of the present invention in detail. Referring to FIGS. 1-2, a cable assembly according to the preferred embodiment of the present invention is provided and comprises an insulative housing 10, a plurality of contacts 20 received in the insulative housing, a printed circuit board (PCB) 6, a cover 3, a cable 4 and an enclosing member 5.

The insulative housing 10 includes an elongated base portion 11 and a mating portion 12 extending forwardly from a front side of the base portion 11. The mating portion 12 has two ports 120 arranged in juxtaposed manner and spaced from each other by a key. Each port 120 has an L-shaped configuration. A plurality of contact grooves 121 are arranged along a transversal direction B-B and run through the mating portion 12 along a mating direction A-A. The base portion 11 is broader than the mating portion 12 along a vertical direction C-C. The base portion 11 has a first flange 113 and a second flange 114 which are respectively located above and below the mating portion 12. The first flange 113 is shorter than the second flange 114 in the vertical direction C-C.

The contacts 20 are arranged into two distinct rows along the transversal direction B-B and inserted into the contact grooves 121 along the mating direction A-A. Each of the contacts 20 has a contacting portion 21 projecting into the portion 120 for electrically contacting with a mating connector (not shown), and a tail portion 22 extending out of the base portion 11.

Figure 3:
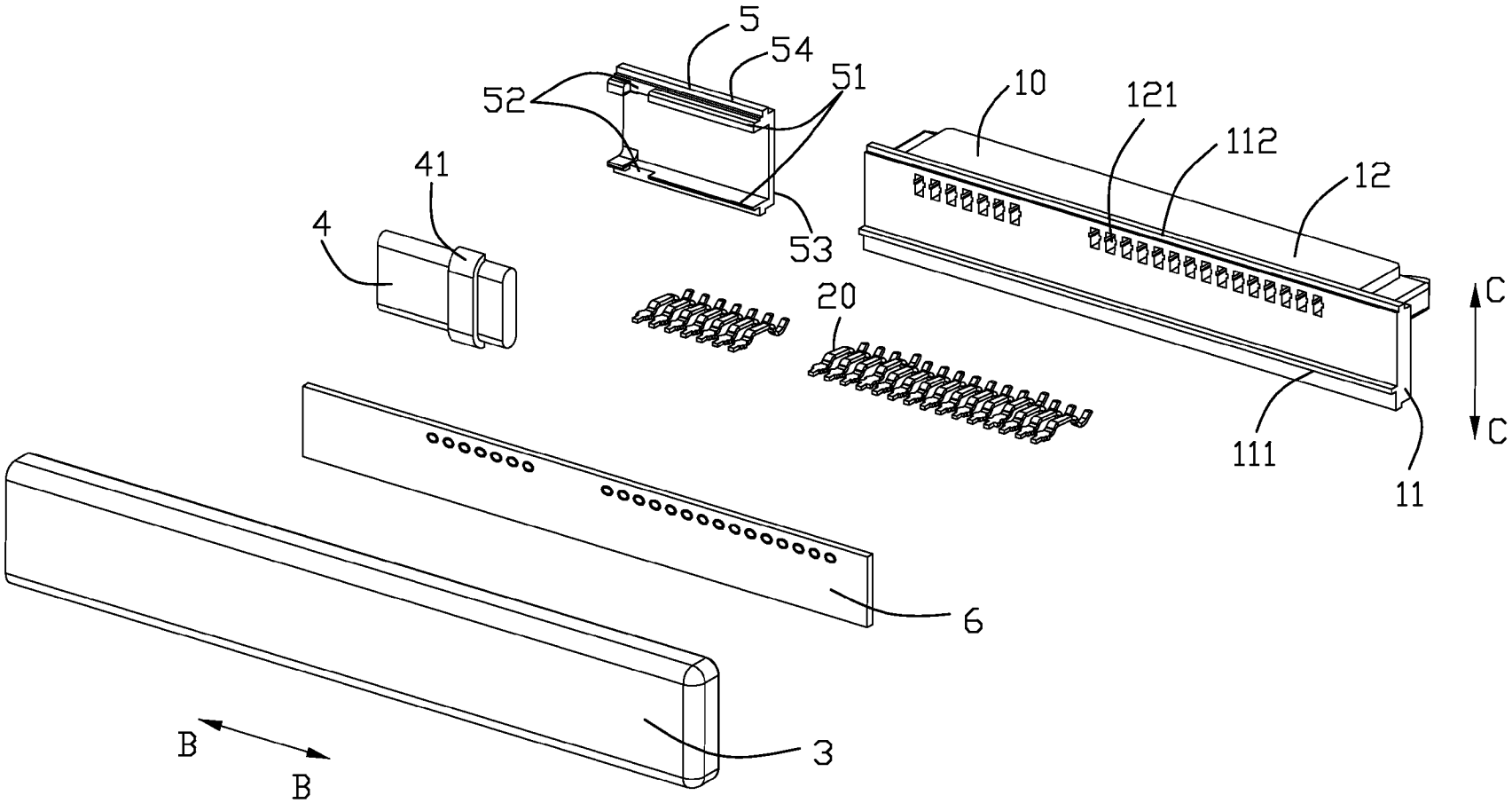
FIG. 3 is another exploded perspective view of the cable assembly shown in FIG. 1.
Figure 4:
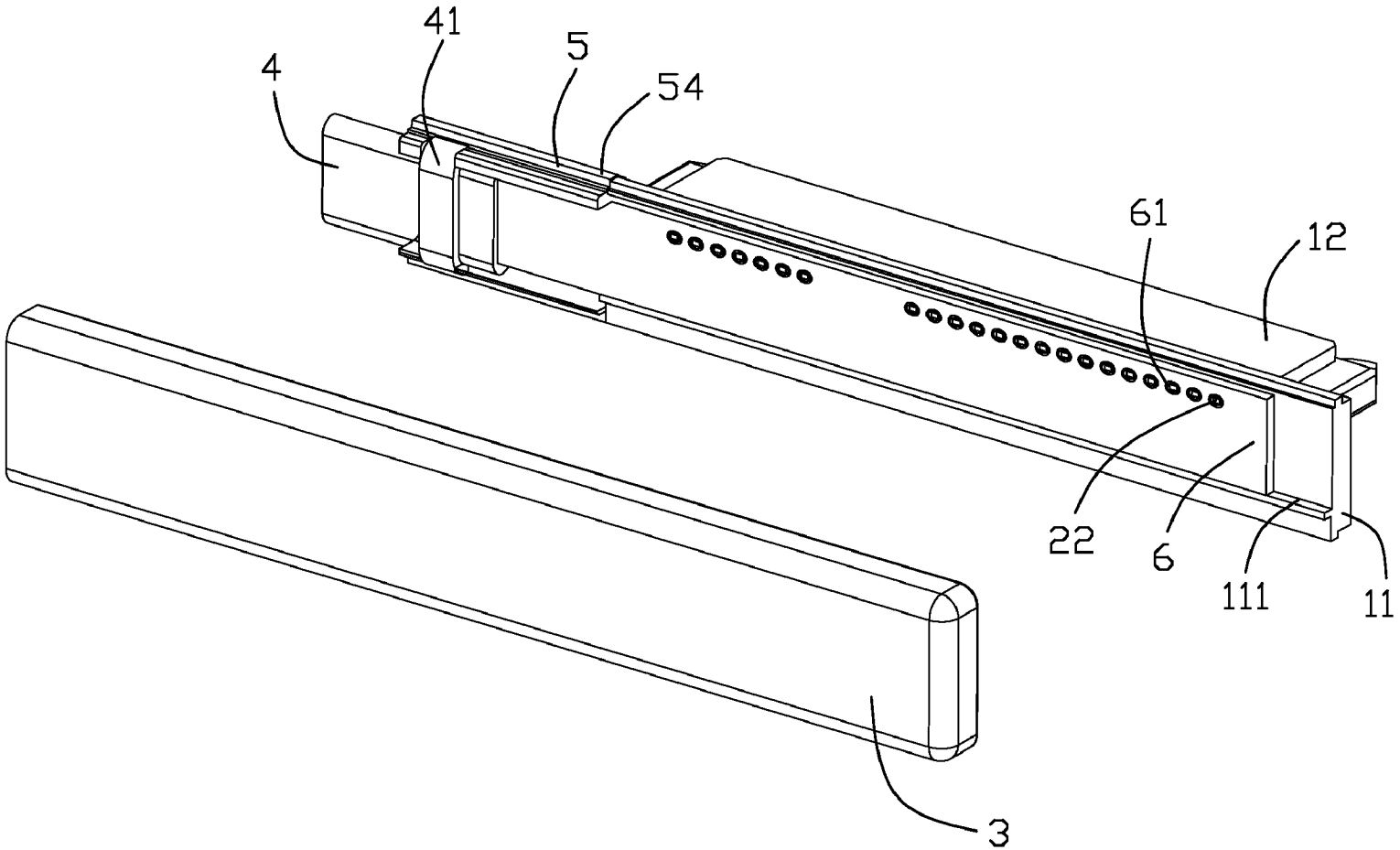
FIG. 4 is a partly assembled perspective view of the cable assembly shown in FIG. 3.

Referring to FIGS. 3-4, a rib like supporting rib 111 protrudes rearward from a rear side of the base portion 11 and forms a supporting platform to support a lower edge of the PCB 6 when the PCB 6 is assembled onto the base portion 11. The supporting portion 111 is located adjacent to the second flange 114 of the base portion 11 and faces to the tails 22 of the contacts 20. The PCB 6 with a plurality of holes 61 thereon is assembled onto the rear side of the base portion 11 along the mating direction A-A. The tails 22 of the contacts 20 extend out of the contact grooves 121 and insert into the corresponding holes 61 on the PCB to be finally soldered onto the PCB. The lower edge of the PCB 6 abuts against the supporting portion 111 in the vertical direction C-C and the PCB 6 is located within the supporting portion 111, therefore the PCB 6 is snugly fitted into the insulative housing 10 and doesn't add the entirely thickness of the insulative housing 10 in the mating direction A-A at all. The upper edge of the PCB 6 is located under the first flange 113 of the base portion 11, therefore the height of the insulative housing 10 is not changed, either.

The insulative housing 10 together with the plurality of contacts 20 received therein form a standard serial ATA connector 1. As the existence of the supporting portion 111, the electrical connector 1 can receive a PCB therein without adding the thickness of the electrical connector in the mating direction A-A, which just meets the demand for low profile connector.

The cover 3 includes a back wall 30 and a pair of top and bottom walls 31, 32 extending forwardly from the back wall 30 to enclose a receiving space therebetween. The bottom wall 32 defines substantially a U-shaped slot or guiding/restriction channel 33, while the top wall 31 defines an inverted U-shaped slot or guiding/restriction channel 33. Both of the slots 33 are facing to each other and communicate with the receiving space.

The enclosing member 5 includes a vertical wall 53, a top and bottom walls 51 connected to upper and lower sections of the vertical wall 53. A pair of apertures 52 are respectively defined at same ends of the top and bottom walls 51.

Figure 5:
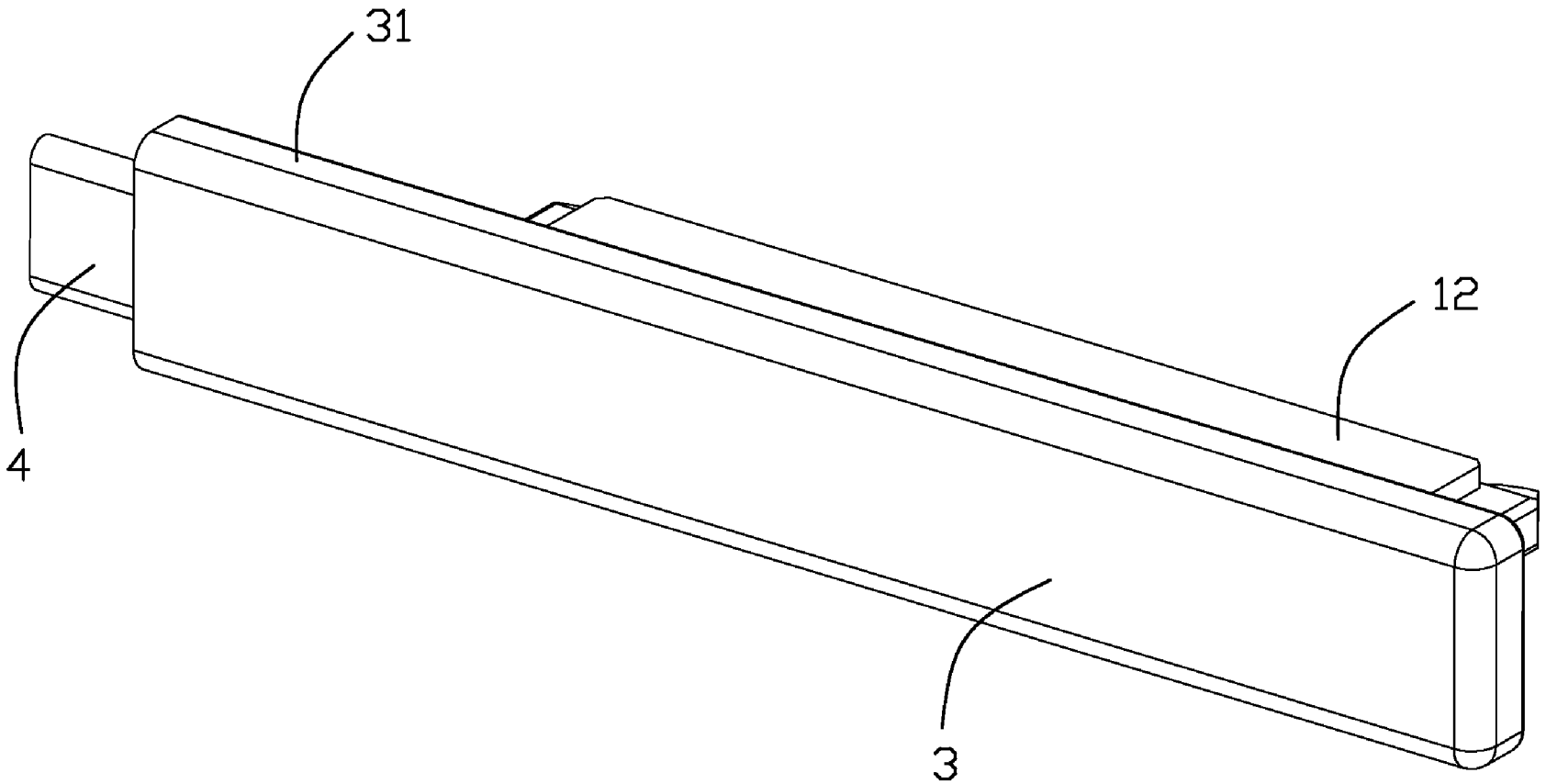
FIG. 5 is another assembled perspective view of the cable assembly shown in FIG. 1.
Figure 6:
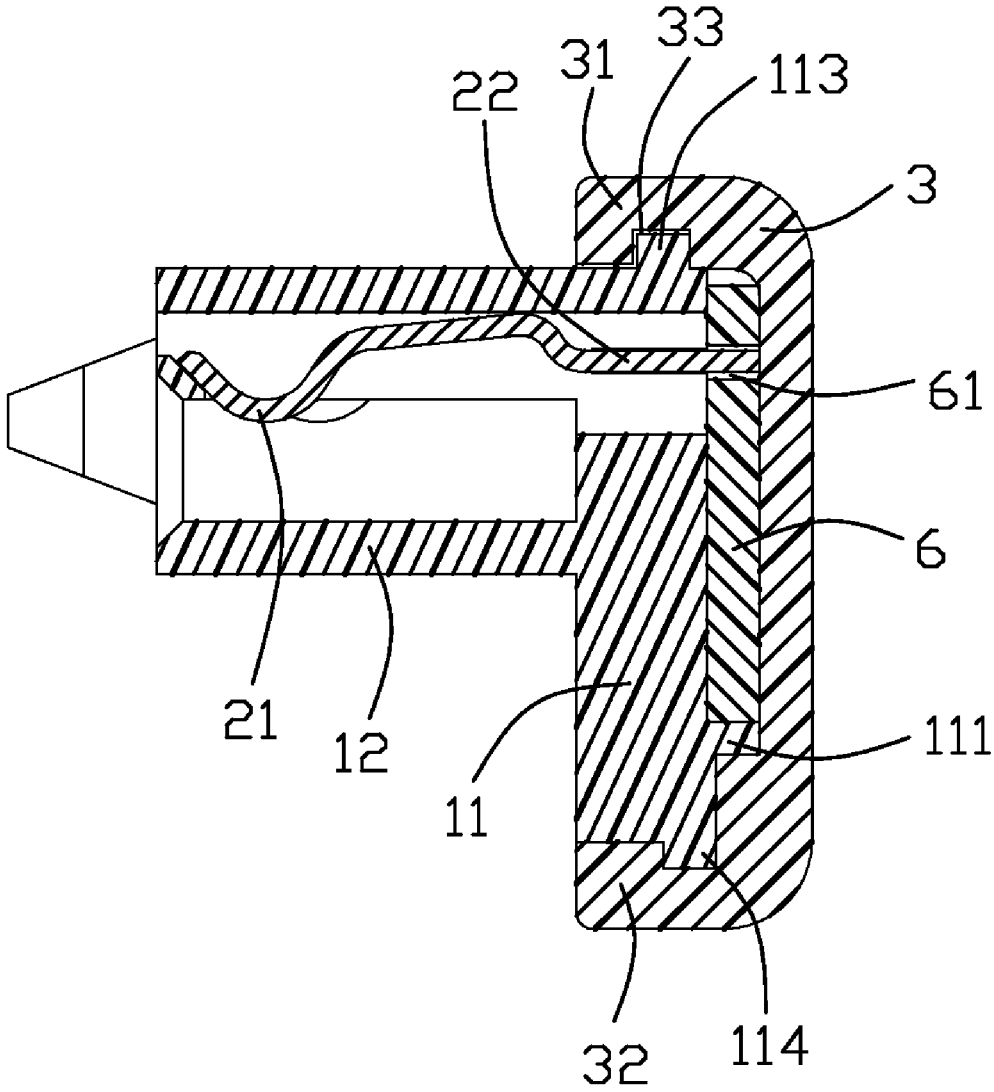
FIG. 6 is a cross-section view of the cable assembly shown in FIG. 1 along line 6-6.

Referring to FIGS. 4-5, the cable 4 is connected to a free end of the PCB 6 after the PCB 6 is mounted onto the electrical connector 1, and part of the cable 4 exposes to an exterior of the insulative housing 10 along the transversal direction B-B. Then, the enclosing member 5 is assembled onto the cable 4 along the mating direction A-A to sandwich the cable 4 between the top and bottom walls 51, meanwhile protrusions 41 which protrude outward from the cable 4 are accommodated in the apertures 52. The enclosing member 5 also forms a pair of flanges 54 in align with the first and second flange 113, 114 of the insulative housing 10 in the transversal direction B-B.

The cover 3 is assembled onto the electrical connector 1 along the transversal direction B-B. The first and second flanges 113, 114 are respectively inserted into the slots 33 on the top and bottom walls 31, 32, therefore the cover 3 can smoothly slide onto the electrical connector 1 until the ends of the top and bottom walls 31, 32 surround the flange of the enclosing member 5. As the cover 3 is assembled onto the electrical connector 1 along the transversal direction B-B, the thickness of the electrical connector assembly in the mating direction A-A can be configured to a minimum dimension.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising:

an insulative housing having a body portion and a mating portion extending forward from a front side of the body portion along a mating direction, the body portion forming a supporting portion protruding rearward and extending along a transversal direction thereof;

a plurality of contacts disposed in the insulative housing with front contacting sections exposed in the mating section and rear tails opposite to the front contacting sections;

a printed circuit board stood within the supporting portion and electrically and mechanically connected with the tails of the contact;

a cable connected to a free end of the printed circuit board;

a cover assembled onto the insulative housing to enclose said printed circuit board therein; and an enclosing member which comprises a vertical wall and an upper and lower walls enclosing a receiving cavity for accommodating the cable, the upper and lower walls respectively form an aperture for locking with the protrusions formed on the cable;

wherein the body portion forms a first flange and a second flange at each vertical ends, respectively, said supporting portion is located above the second flange and far away from the first flange, an upper edge of the printed circuit board is under the first flange while a lower edge of the printed circuit board abuts against the supporting portion thereby the height of the cable assembly in a vertical direction is not changed by the printed circuit board;

wherein the cover comprises a vertical wall and a pair of top and bottom walls at opposite ends thereof, said top and bottom walls respectively define a slot running along the transversal direction, therefore the cover is assembly on to the insulative housing along the transversal direction and the first and second flanges of the body portion are respectively received in the corresponding slots;

wherein the cover is assembled onto the insulative housing from an end of the body portion opposite to the position of the enclosing member, then the cover slides along the transversal direction until the enclosing member is finally received in the cover.

2. The cable assembly as described in claim 1, wherein the cover comprises a vertical wall and a pair of top and bottom walls at opposite ends thereof, said top and bottom walls respectively define a slot running along the transversal direction, therefore the cover is assembly on to the insulative housing along the transversal direction and the first and second flanges of the body portion are respectively received in the corresponding slots.

3. An electrical cable connector assembly comprising:

an insulative elongated cover defining therein a receiving space and a lengthwise direction, a transverse direction and a front-to-back direction perpendicular to one another;

an insulative housing defining an elongated main body and an elongated mating portion forwardly extending therefrom;

guiding structures formed on both said cover and said housing to allow said housing to be assembled to said cover only along only one of said lengthwise direction and said transverse direction and thus unable to move along the other of said lengthwise direction and said front-to-back direction under condition that the main body is received in the receiving space;

an elongated printed circuit board intimately positioned behind said housing and extending in a plane defined by said elongated direction and said transverse direction;

a plurality of contacts disposed in the housing, each of said contacts including a contacting section exposed in the mating portion and a mounting portion electrically and mechanically connected to the printed circuit board; a cable connected to a lengthwise end of the printed circuit board and extending along said lengthwise direction and toward an exterior out of a lengthwise end of the cover; and an enclosing member attached to the cover and beside the housing in said lengthwise direction to prevent withdrawal of said housing from the cover in said lengthwise direction; wherein said printed circuit board is sandwiched between the housing and the cover in said front-to-back direction;

wherein said housing is essentially enclosed in the cover in said transverse direction;

wherein said guiding structures extend along the lengthwise direction.

4. The electrical cable connector assembly as claimed in claim 3, wherein said housing is further equipped with an elongated supporting rib to engage, in said transverse direction, a lengthwise edge of the printed circuit board.

5. The electrical cable connector assembly as claimed in claim 3, wherein a front face of the cover is coplanar with a front face of the main body of the housing.

6. The electrical cable connector assembly as claimed in claim 3, wherein said cable is prevented from movement along said lengthwise direction by one of said cover and said enclosing member.

7. The electrical cable connector assembly as claimed in claim 6, wherein said cable is engaged with said enclosing member for prevention of movement along said lengthwise direction.

8. The electrical cable connector assembly as claimed in claim 3, wherein said enclosing member is assembled to the cover along said lengthwise direction.

9. The electrical cable connector assembly as claimed in claim 8, wherein said enclosing member is assembled to the cover via said guiding structure on the cover shared with the housing during assembling of the housing to the cover.

10. The electrical cable connector assembly as claimed in claim 9, wherein said cable is enclosed in the enclosing member in the transverse direction, and is shielded by both said enclosing member and said cover in the front-to-back direction.

* * * * *